United States Patent [19]

Alexander

[11] Patent Number: 4,464,964

[45] Date of Patent: Aug. 14, 1984

[54] ARTICULATED SAW

[76] Inventor: Carl J. Alexander, 54092 Wilbur Rd., Three Rivers, Mich. 49093

[21] Appl. No.: 338,235

[22] Filed: Jan. 11, 1982

Related U.S. Application Data

[63] Continuation-in-part of Ser. No. 59,985, Jul. 23, 1979, Pat. No. 4,309,931, which is a continuation-in-part of Ser. No. 944,202, Sep. 19, 1978, abandoned, Continuation of Ser. No. 697,978, Jun. 21, 1976, abandoned.

[51] Int. Cl.[3] ..... B27B 17/02

[52] U.S. Cl. ..... 83/830

[58] Field of Search ..... 83/830–834; 30/386, 387; 125/21, 22

[56] References Cited

U.S. PATENT DOCUMENTS

| | | | |
|---|---|---|---|
| 827,009 | 7/1906 | Gray et al. | 83/832 |
| 1,273,394 | 7/1918 | Meyer | 83/831 X |
| 1,392,503 | 10/1921 | Jackson | 83/830 |
| 1,467,150 | 9/1923 | Frere | 83/830 |
| 1,671,295 | 5/1928 | Kirby | 83/832 |
| 1,766,013 | 6/1930 | Daw | 83/830 |
| 1,779,083 | 10/1930 | Bens | 83/832 |
| 1,979,001 | 10/1934 | Kankos | 83/831 |

*Primary Examiner*—James M. Meister

*Attorney, Agent, or Firm*—Dressler, Goldsmith, Shore, Sutker & Milnamow, Ltd.

[57] ABSTRACT

A power driven saw is provided with an endless array of planar cutting members interconnected to form an articulated saw blade that resists inward bending. The cutting members are disposed about the periphery of an elongated saw blade support structure to present a circumferential band of cutting teeth.

10 Claims, 11 Drawing Figures

ARTICULATED SAW

CROSS REFERENCE TO RELATED APPLICATIONS

This application is a continuation-in-part of my copending U.S. patent application Ser. No. 59,985, entitled "Articulated Saw," filed July 23, 1979, now U.S. Pat. No. 4,309,931, as a continuation-in-part of my U.S. patent application Ser. No. 944,202 entitled "Articulated Saw," now abandoned and filed Sept. 19, 1978 as a continuation of my application Ser. No. 697,978, filed June 21, 1976, now abandoned.

BACKGROUND OF THE INVENTION

The present invention is related to saws, and more particularly, to power driven saws which utilize an endless array of cutting teeth.

The use of chain saws in many applications is not without disadvantages. Compared to carpenter's handsaws and power band saws, the kerf of a chain saw is much wider. The wider kerf is undesirable for two reasons: (1) the wider kerf removes more material from the cut than the narrower kerf would and thus converts a larger portion of the material being cut to waste, and (2) removal of more material from the cut requires more power input for cutting.

Saws, such as a hand saw or those employing reciprocating saw blade mechanisms, have the disadvantage of inefficiency associated with the return stroke.

The band saw has the advantage over the reciprocating saw in that return stroke efficiency is eliminated as the band saw operates to continuously cut. Further, the band saw has a much narrower kerf as compared to the chain saw. However, the use of a band saw also has disadvantages. First, the band saw has a throat limitation which limits the size of the material being cut. And, of course, the throat limitation of a band saw limits the effectiveness of the band saw if it were to be used in some portable embodiment. Secondly, a band saw blade is constantly undergoing bending and flexing as it is engaged by the drive and idler wheels. Since the band saw blade must be able to withstand the flexing and bending, the blade is limited to certain suitable flexible materials and to appropriate hardness tempers.

The saw of the present invention substantially mitigates or eliminates the disadvantages associated with the other types of currently employed saw devices yet incorporates many of the desirable features of the chain saw and the band saw.

SUMMARY OF THE INVENTION

This invention contemplates a power-driven articulated saw blade mounted on a frame and a blade support structure therefor to provide a saw having the general shape and portability of a conventional portable chain saw but having a substantially narrower kerf. The articulated blade is substantially planar and comprises interconnected, relatively thin, planar cutting members in an endless array. Each cutting member has a pair of opposed longitudinal margins and a pair of end margins. A plurality of cutting teeth is provided along one of the longitudinal margins to define a cutting face.

In a preferred embodiment of the saw blade of the present invention, the cutting face of each cutting member is substantially planar. That is, the top edges of all cutting teeth along the longitudinal margin of a cutting member and having the same shape lie substantially in a common plane. However, it is to be realized that the edges of the cutting teeth on a cutting member may define, if desired, a curve or other non-planar profile along the longitudinal margin of the cutting member.

Preferably the cutting members also are disposed substantially end to end to form an articulated band and to present a circumferential row of cutting teeth about the periphery of the band. The array of cutting members is adapted to define at least a cutting region or segment of the band wherein the cutting faces of a plurality of cutting members define and lie along a cutting surface.

The saw blade of the present invention is adapted to be mounted on a saw blade support structure, preferably one that defines a convexly curved or crowned support for the saw blade in the cutting region or segment of the saw so that the profile of the cutting region of the saw blade, and hence the cutting surface, is slightly convex. However, the saw blade per se, when it is not mounted on the saw, can be arranged so that the cutting faces of a plurality of adjacent cutting members lie in the same general flat plane. This permits the saw blade to also be used on a saw having a flat or straight cutting region.

The present saw blade has a novel structure that permits rotation of any two adjacent cutting members in respective opposing first directions out of a generally straight line alignment but prevents rotation of the adjacent cutting members out of the straight line alignment in opposing respective second directions that are also opposite to the first directions. In other words, in those embodiments wherein the cutting members have planar cutting faces, the blade structure permits rotation of any two adjacent cutting members in opposite directions out of the plane defined by the cutting faces so that the planar cutting faces face away from each other. Rotation in the opposite directions beyond this plane is prevented.

If the articulated saw blade is carried on a saw blade support structure which has a slight radius or crown so as to position the cutting members to define a generally convex cutting surface, rotation of any two adjacent cutting members with planar cutting faces in opposite directions out of the convex cutting surface is possible in either direction for each cutting member—but only so long as the included angle formed between the plane of the cutting faces of two adjacent cutting members is not less than about $\pi$ radians (i.e., substantially a straight angle). In other words, rotation of adjacent cutting members beyond the 180° or straight angle orientation wherein the cutting faces of adjacent cutting members would begin to face each other is prevented.

Numerous other advantages and features of the present invention will become readily apparent from the following detailed description of the invention and of embodiments thereof, from the claims, and from the accompanying drawings in which each and every detail shown is fully and completely disclosed as a part of this specification.

BRIEF DESCRIPTION OF THE DRAWINGS

In the accompanying drawings forming part of the specification, and in which like numerals are used to designate like parts throughout the same.

DESCRIPTION OF PREFERRED EMBODIMENTS

Figure 1:
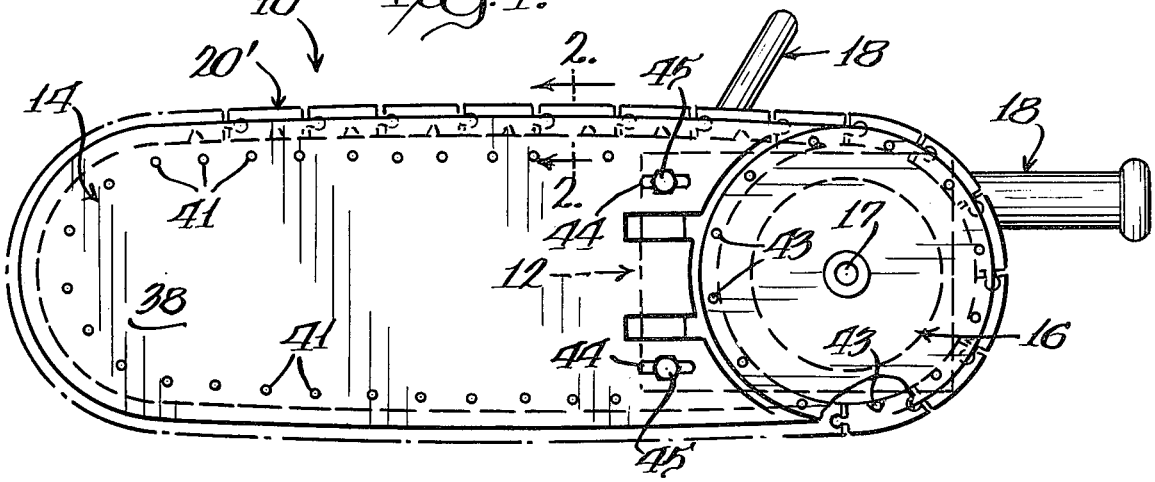
FIG. 1 is a side elevation view of a saw embodying this invention, partially broken away to show interior detail, and provided with an articulated saw blade.

While this invention is susceptible of embodiment in many different forms, there is shown in the drawings and will herein be described in detail preferred embodiments of the invention with modifications thereof, with the understanding that the present disclosure is to be considered as an exemplification of the principles of the invention and is not intended to limit the invention to the embodiments illustrated. The scope of the invention will be pointed out in the appended claims.

This patent application and description incorporates herein by reference the disclosures of my above-identified copending U.S. patent application Ser. No. 59,985, now U.S. Pat. No. 4,309,931.

One embodiment of the saw of the present invention is generally designated by reference numeral 10 in FIG. 1. Saw frame 12 (hidden in FIG. 1 and shown in dashed line) is provided to mount saw blade support 14 and saw blade drive means 16. Connected to frame 12 are handles 18. Saw 10 is portable and can be held by handles 18 for cutting at any angle.

A first embodiment of an articulated saw blade 20′ of this invention is disposed about the periphery of saw blade support 14 and engaged at one end of saw 10 by saw blade drive means 16 which, in turn, is driven via shaft 17 by a suitable prime mover such as an electric motor, an internal combustion engine, or the like (not visible in FIG. 1). Such a basic saw construction is described in more detail in the above-identified copending U.S. patent application Ser. No. 59,985, now U.S. Pat. No. 4,309,931 and reference is directed thereto (and specifically to saw 10 in FIG. 1 thereof).

Figure 3:
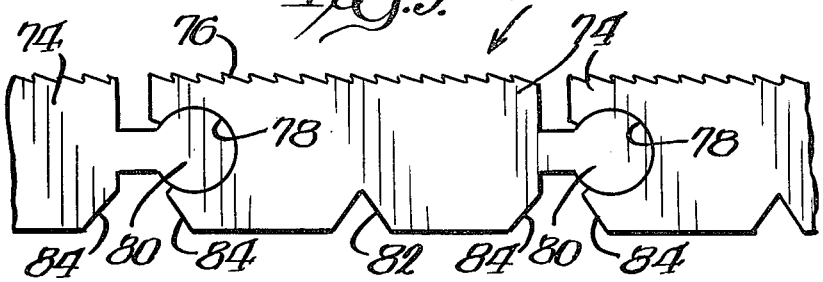
FIG. 3 is an enlarged, side elevation view of the articulated saw blade shown in FIGS. 1 and 2.

The first embodiment of a saw blade 20′ of this invention is shown in greater detail in FIG. 3. One row of planar cutting members 74 is utilized in this embodiment and the consecutive cutting members 74 are disposed substantially end to end in an interconnected endless array to form a substantially planar, articulated band.

Cutting members 74 are substantially flat and are generally rectangular in shape having opposed longitudinal margins and opposed end margins. Provided on one of the longitudinal margins of each cutting member 74 is a plurality of cutting teeth 76 which are generally in the plane of the cutting member and which define a cutting face.

Individual cutting members 74 are joined together by pivotal connection means integral therewith. One end margin of each cutting member 74 is provided with an inwardly extending arcuate notch 78, the major portion of which is defined by a circular arc which receives a complementary, planar extending projection 80 from an adjacent cutting member 74.

Extending projection 80 is of a configuration adapted to fit within arcuate notch 78 and thus form a pivotable interconnection therewith. To this end, extending projection 80 is generally circular in shape to substantially match the circular arc of the notch. This connecting means or structure permits rotation of the adjacent connected cutting members 74 in opposing first directions wherein the cutting faces face away, or are angled away, from each other as the blade travels around the shorter radius of curvature of the saw ends. In order that extending projection 80 not be pulled out of engagement with the circular notch 78, it is necessary that the circular arc of material forming the circular notch 78 extends greater than $\pi$ radians or 180°.

To allow for the pivotal movement of cutting members 74 as they ride around the more curved end portions of an elongated saw blade support driven by pins or the like engaging drive engagement means or V-shaped notches 82, bevels 84 are provided on each end of cutting members 74 and the extent of the circular notch is preferably less than about $3/2\pi$ radians or about 270°. With the type of single-row, connected, cutting member articulated saw blade shown in FIG. 3, a cut having a very narrow kerf can be achieved.

Figure 2:
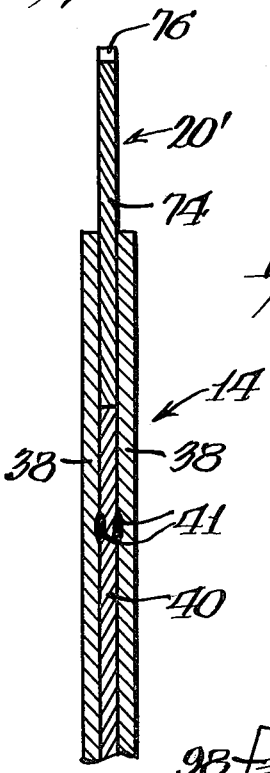
FIG. 2 is an enlarged, fragmentary cross sectional view taken along the plane 2—2 in FIG. 1.

FIG. 2 best illustrates how the first embodiment of the saw blade 20′ is mounted on the saw 10. Specifically, the saw blade support 14 comprises two elongated blade support side retaining members 38 and one elongated blade support center member 40 disposed between the two side retaining members 38. Side retaining members 38 are joined to the center member 40 with spot welds 41. Spot welds 41 can be disposed generally uniformly about the periphery of the saw blade support 14 as best shown in FIG. 1. Preferably, the longitudinal side edges of the saw blade support 14 are provided with a slight crown. Alternatively, the saw blade support 14 can be machined from a single piece, as by diamond wheel milling of a slot in the end face of a suitably shaped plate.

As illustrated in FIG. 2, the articulated saw blade 20′ is mounted on the saw blade support 14 with the lower portion of each of the cutting members 74 disposed within the slot formed between the extending peripheral portions of the two side retaining members 38. The bottom surface of each cutting member 74 is supported upon the support face provided by the periphery of the blade support center member 40. This structure retains the articulated saw blade 20′ within the saw blade support 14 and provides continuous support for each cutting member 74 as the saw blade 20′ cuts.

When the saw blade 20′ is mounted on the saw 10 as in FIG. 1, the portion of the blade 20′ between the curved ends of the saw 10 defines a cutting region or segment wherein the cutting faces of a plurality of the cutting members 74 define and lie along a cutting surface. A workpiece is preferably cut along this cutting surface between the curved ends of the saw 10.

Figure 3A:
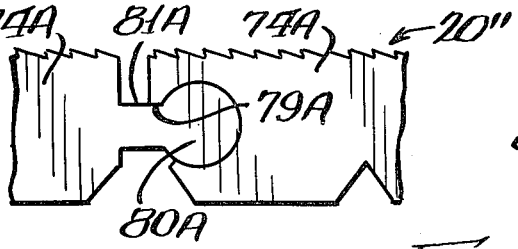
FIG. 3A is a side elevation view of a modified embodiment of the saw blade shown in FIG. 3.

A modification of the saw blade 20' is shown in FIG. 3A and designated by reference numeral 20'' therein. The saw blade 20'' includes cutting members 74A generally similar to the cutting members 74 of blade 20' shown in FIG. 3 except that one end of each cutting member 74A extends forwardly of the arcuate notch 78A to define an engaging surface 79A. A portion of the other end of each cutting member 74A defines an upwardly facing abutment surface 81A adjacent the circular projection 80A.

The abutment surface 81A and engaging surface 79A function to prevent substantial rotation of adjacent connected cutting members in opposite directions out of the cutting surface through an angle formed between the planes of the cutting faces of two adjacent cutting members not less than about $\pi$ radians. In other words, the cutting members are prevented from rotating beyond the 180° or straight angle orientation wherein the cutting faces of adjacent cutting members 74A would begin to face each other. Thus, in the event that blade support 14 had flat or even concave sections along the cutting region, blade 20'' will be substantially rigid and strong when it is cutting a work piece in the cutting region and blade 20'' will resist inward flexing or bending.

Figure 5:
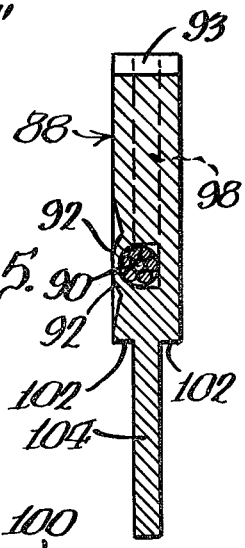
FIG. 5 is a cross sectional view taken along plane 5—5 in FIG. 4.
Figure 4:
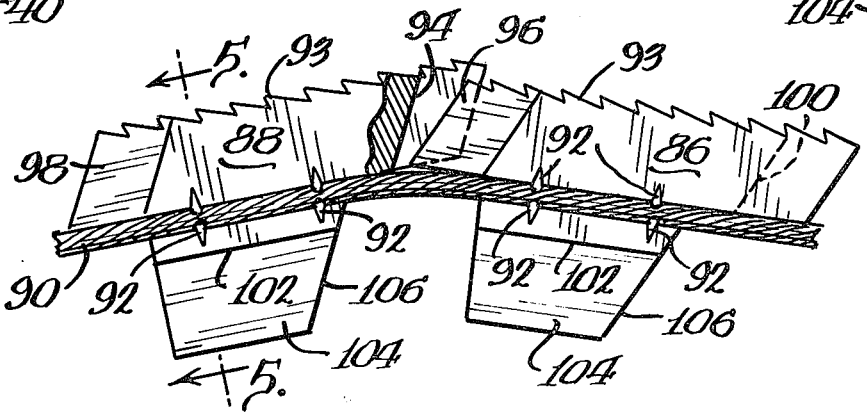
FIG. 4 is a side elevation view of an articulated saw blade illustrating another embodiment of this invention.

FIGS. 4 and 5 show a second embodiment of the saw blade of the present invention. Identical, individual planar cutting members 86 and 88, with teeth 93, are spaced in end-to-end relation and hingedly connected to one another by steel cable 90 or the like which is disposed within a channel 89 in each cutting member and crimped to each cutting member with a plurality of crimps 92. The cable 90 and crimp connection 92 is shown in cross section in FIG. 5. A plurality of cutting members 86 and 88 are thus secured to a loop of cable 90 to form an endless array of cutting members defining an articulated band or saw blade.

Cutting members 88 and 86 are identical in shape. Each member has an end slot and an end projection which receive and engage, respectively, the end projection and end slot of adjacent members whereby the articulated band of connected cutting members is interlocked to resist lateral forces. Specifically, cutting member 88 is illustrated as having end slot 94 receiving end projection 96 of cutting member 86. On the opposite end of member 88 is end projection 98 and on the opposite end of member 86 is end slot 100.

Each cutting member includes shoulder 102 on each side of central keel portion 104 for supporting the cutting member on the periphery of a blade support member, such as on the retaining plates 38 of blade support member 14 (illustrated in FIG. 2). Keel portion 104 is adapted to be slidably disposed within the central slot of such a blade support 14. If desired, the cutting members can be designed so that the shoulders 102 are elevated above the periphery of the support member and so that only the bottom of the keel portion 104 supports each cutting member on the blade support center member 40 (FIG. 2).

Again, to allow cutting members 86 and 88 to follow the curved ends of a saw blade support 14, bevels 106 can be provided at the ends of cutting members below the fulcrum point on cable 90 and/or sufficient space can be maintained between the cutting members along cable 90.

With the above-described novel cable connection structure cooperating with the end slot and end projection structure, rotation of the adjacent connected cutting members 88 and 86 is permitted in opposing first directions wherein the cutting faces of teeth 93 begin to face away from each other as the blade travels around the curvature of the saw. Further, the novel end slot and end projection structure of the cutting members functions to limit rotation of adjacent cutting members in second directions (opposite to the first directions) beyond a generally straight line ($\pi$ radians) along identical points on each cutting member. That is, the adjacent cutting members 86 and 88 cannot rotate away from the saw blade support 14 beyond the orientation wherein the cutting faces of teeth 93 lie in a substantially common plane. This provides a strong and rigid cutting blade even if the cutting member shoulders 102 are spaced above the saw blade support side retaining members 38 and only the keel portion 104 is supported on the center member 40 of the saw blade support 14.

Figure 6:
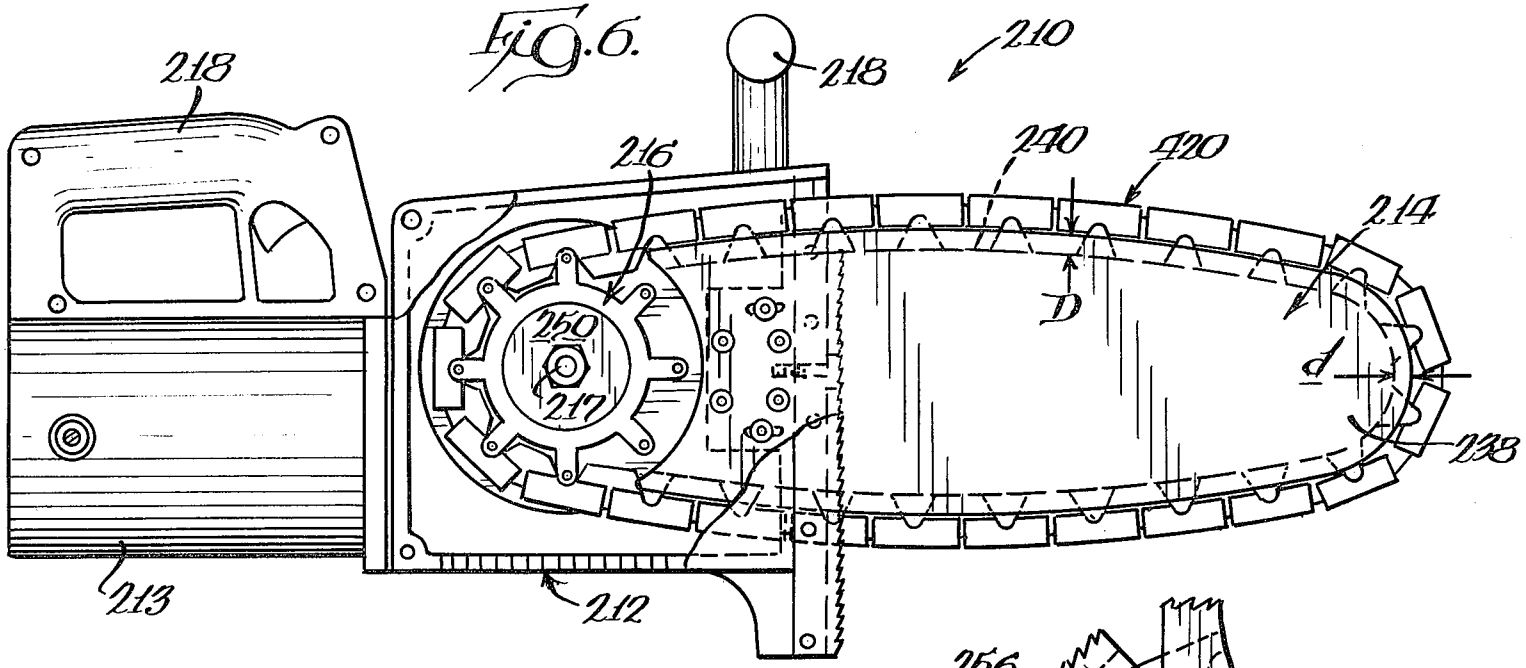
FIG. 6 is a side elevation viewal of another embodiment of the saw of this invention, partially broken away to show interior detail, and provided with an articulated saw blade of this invention different from that shown in FIGS. 1–3 and FIGS. 4–5.
Figure 7:
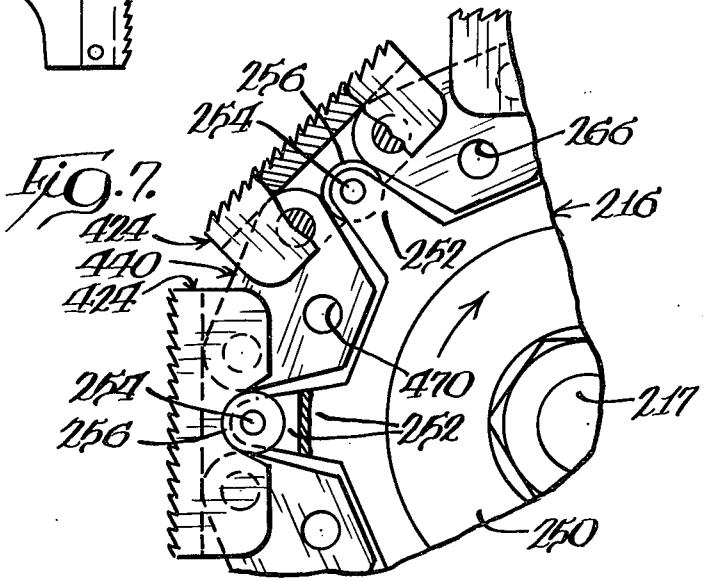
FIG. 7 is a fragmentary view of a portion of the saw illustrated in FIG. 6.

A second embodiment of the saw of the present invention is generally designated by reference numeral 210 in FIGS. 6 and 7. Saw 210 includes saw frame 212 on which is mounted saw blade support 214, saw blade drive means 216, and motor 213. Saw 210 is portable and can be held by handles 218 for cutting at any angle.

A third embodiment of an articulated saw blade, designated generally by reference numeral 420 and described in detail hereinafter, is disposed about the periphery of saw blade support 214 and engaged at one end of saw 210 by saw blade drive means 216 which, in turn, is driven via shaft 217 by motor 213 operating through a suitable gear drive system. Of course, the motor 213 may be an electric motor, an internal combustion engine, or other suitable prime mover. The structure of the saw 210 per se, apart from the saw blade, is described in more detail in the above-identified copending U.S. patent application Ser. No. 59,985, now U.S. Pat. No. 4,309,931, and reference is directed to saw 210 illustrated in FIGS. 13–17 of that patent application.

Figure 8:
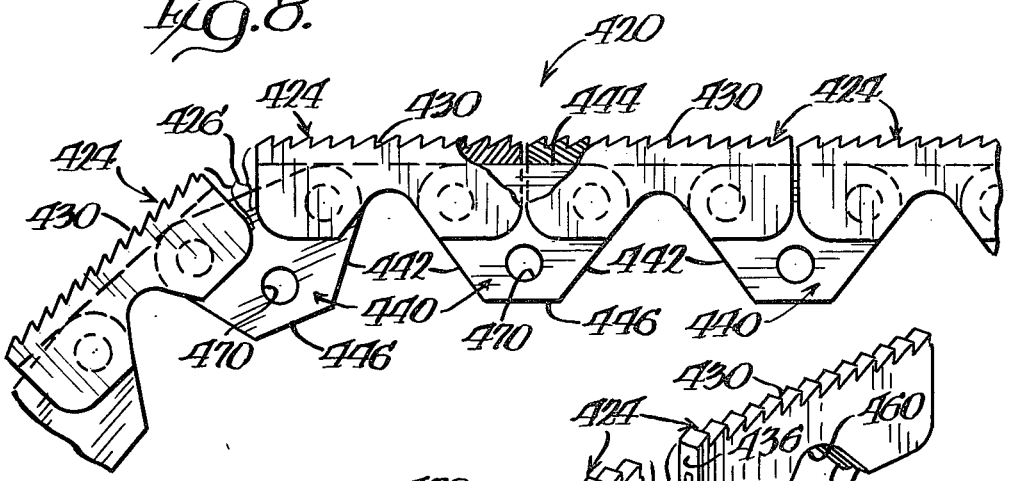
FIG. 8 is an enlarged, side elevational view of the articulated saw blade of this invention illustrated in FIG. 6.
Figure 9:
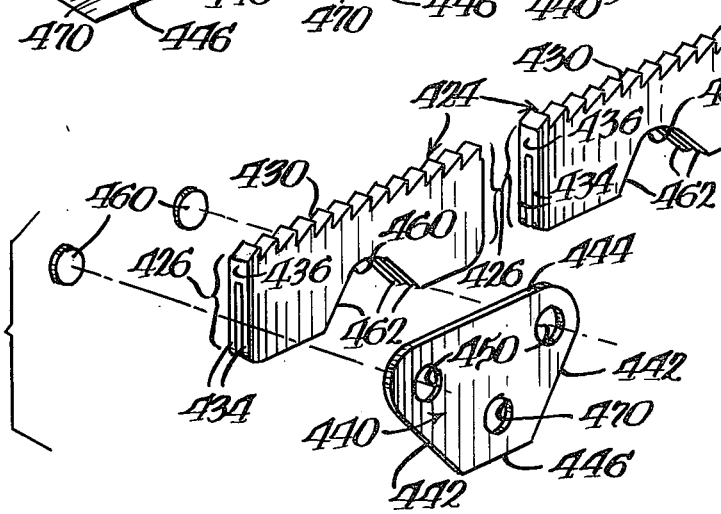
FIG. 9 is an exploded perspective view of the articulated saw blade shown in FIG. 8.

Saw blade 420 is best illustrated at FIGS. 8 and 9. Blade 420 comprises an endless array of substantially planar cutting members 424 which are disposed substantially end to end to form a substantially planar, articulated band.

Each substantially planar cutting member 424 in the endless array has a pair of opposed end margins 426. Each cutting member 424 also has a pair of opposed longitudinal margins, one of the longitudinal margins defining the bottom of cutting member 424 and the other of the longitudinal margins defining the top of cutting member 424 which includes a plurality of cutting teeth 430 that define a cutting face thereon. Cutting teeth 430 of each cutting member 424 together form a substantially continuous circumferential row of cutting teeth about the periphery of articulated blade 420.

As best illustrated in FIG. 9, each cutting member 424 includes a pair of spaced-apart sidewalls 434 which are open along the lower portions of the cutting member end margins 426 and along the bottom of the cutting member opposite the cutting teeth 430. Sidewalls 434 are connected together inwardly (upwardly) of the bottom of the cutting member at crosswall 436.

Blade 420 includes means for connecting the cutting members in the endless array so that some number of cutting members can be oriented in a generally straight line along identical points on each cutting member as illustrated in FIG. 8. Specifically, the connecting means includes planar link members 440 which are disposed in spaced end-to-end relationship. Each link member 440 has a pair of end margins 442 and a pair of opposed longitudinal margins that include top longitudinal margin 444 and bottom longitudinal margin 446.

An end margin 442 of one link member 440 is adapted to be received between the spaced-apart sidewalls 434 at one end of one of the cutting members 424. Similarly, the other end margin 442 of link member 440 is adapted to be received between the sidewalls 434 of another cutting member 424.

Means are provided for connecting each cutting member 424 to a link member 440. Specifically, within each end margin 442 of link member 440 is journal bearing 450. Journal bearing 450 presents a substantially right cylindrical bearing surface through each end of each link member 440. A journal 460 is disposed within each journal bearing 450. Each journal 460 is a small disc-shaped shaft and connects the spaced-apart sidewalls 434 of a cutting member 424 on either side of link member 440. Journal 460 is free to rotate within journal bearing 450, but is secured by appropriate means, such as by electron beam welding or the like, to sidewalls 436 of cutting member 424.

As can be seen for the cutting members on the right-hand side of FIG. 8, the cutting teeth 430 extend across the upper longitudinal margin or top of each cutting member 424 so that the top edges of teeth 430 can lie in a substantially common plane. Further, all cutting members 424 are connected within articulated band 420 so that all cutting teeth 430 are in substantially vertical alignment along any portion of the band when link members 440 in that portion are arranged with their bottom margins 446 in a common plane.

The bottom surface of bottom longitudinal margin 446 of each link member 440 is a bearing surface. This bearing surface supports each link member 440, and hence articulated band 420, in a suitable saw blade support, such as saw blade support 214 of saw 210 illustrated in FIG. 6.

Saw blade support 214 may have a construction generally identical to saw blade support 14 of the first embodiment of saw 10 described above with reference to FIGS. 1 and 2. Preferably as best illustrated in FIG. 6, saw blade support 214 includes a pair of side retaining members 238 generally similar to the side retaining members 38 of the first embodiment of the saw 10 described above with reference to FIGS. 1 and 2. Saw blade support 214 also includes a blade support center member 240 which is generally similar to center member 40 illustrated in FIGS. 1 and 2 for the first embodiment of saw 10 described above.

As best illustrated in FIG. 6, side retaining members 238 preferably extend outwardly beyond the center member 240 a distance D in the cutting region between saw blade drive means 216 and the arcuate distal end of the saw 210. The side retaining members 238 extend outwardly a distance d at the arcuate distal end of the saw 210. The distance D is preferably greater than the distance d. In any case, the novel articulated saw blade 420 of the present invention is retained within saw blade support 214 and saw blade support 214 provides a continuous support for the saw blade link members 440 as will next be explained.

The bottom of each link member 440 extends below the bottom longitudinal margin of each cutting member 424 and is adapted to be received between the two elongated side retaining members 238 of saw blade support 214. The bottom surface of lower longitudinal margin 446 of each link member 440 preferably bears upon, and is supported by, the upwardly facing surface of blade support center member 240. If desired, the bottom surfaces of the lower margins of each cutting member 424 (i.e., the bottom ends of sidewalls 434) may extend to and bear against side retaining members 238. However, in the preferred embodiment, the bottom margins of each cutting member 424 are spaced outwardly away from the saw blade support side retaining members 238.

As best illustrated in FIGS. 8 and 9, the lower longitudinal margin of each cutting member 424, opposite cutting teeth 430, is provided with notch means or a notch defined in each sidewall 434 by arcuate wall 460 and by two generally converging walls 462 that merge with arcuate wall 460. This notch acts as a drive engagement means for being engaged by saw blade drive means 216 as will next be described.

With reference to FIGS. 6 and 7, saw blade drive means 216, disposed at one end of saw blade support 214, comprises a sprocket or drive wheel 250 mounted on shaft 217. Sprocket 250 has a plurality of circumferentially spaced pairs of spaced-apart parallel spokes 252 which project radially outwardly in relation to shaft 217. A shaft 254 is mounted between each pair of spaced-apart parallel spokes 252. A roller 256 is mounted on each shaft 254 for intermittently entering the notches of cutting members 424 and for engaging cutting members 424 to move saw blade 420 around the periphery of saw blade support 214.

Sprocket 250 may be driven by a suitable gear system, such as a skew-axis gear system of conventional design well known to those skilled in the art of drive gear system design.

With the novel articulated saw blade 420 of the present invention, it is preferable that the relative positions of the drive notches of cutting members 424 and the ends of each link member 440 be oriented so that all of the journals 460 are properly aligned and so that the drive notches are uniformly spaced along saw blade 420.

With reference to FIGS. 8 and 9, it can be seen that the end margins 442 of each link member 440 may be slanted so as to accommodate contact with drive rollers 256 on sprocket 250. Thus, with such a design, articulated saw blade 420 is driven at each roller 256 in such a manner that each roller 256 simultaneously engages a cutting member 424 and a link member 440 in the driving direction. This arrangement further distributes the driving force over a larger bearing area.

The notches of cutting members 424 function as chambers to carry sawdust or other cutting material out of the kerf. Additionally, each link member 440 can be provided with one or more holes or apertures 470 adjacent the bottom margin of link member 440 to function as a trap for lubricant so that lubricant can be carried along saw blade support 214.

The novel structure of the articulated saw blade 420 provides a strong blade that resists bending inwardly towards saw support structure 214 when saw blade 420 is cutting a workpiece. Specifically, top margin 444 of each link member 440 functions as an abutment surface. Similarly, the downwardly facing surface of crosswall 436 of each cutting member 424 functions as an engaging surface between sidewalls 434 for engaging the upwardly facing abutment surface of upper margin 444 of a connected link member 440. This engaging surface of cutting member 424 engages the abutment surface of upper margin 444 of a link member 440 when a plurality of cutting members 424 are oriented to form a generally straight line along identical points on each cutting member as illustrated for the members on the righthand side of FIG. 8.

This type of structure permits rotation of any two adjacent cutting members 424 in opposing first directions but prevents rotation of adjacent cutting members 424 out of the straight line orientation in opposing second directions that are opposite to the first directions. In other words, the structure prevents rotation of two adjacent connected cutting members in opposite directions (out of the cutting surface defined by teeth 430) through an angle formed between planes of the cutting faces of the two cutting members of not less than about $\pi$ radians. With this structure, those cutting members being driven through the cutting region of the saw blade support 214 resist inward deflection and provide a strong blade during cutting even though the cutting members may be spaced away from the edges of the side retaining plates 238.

Figure 10:
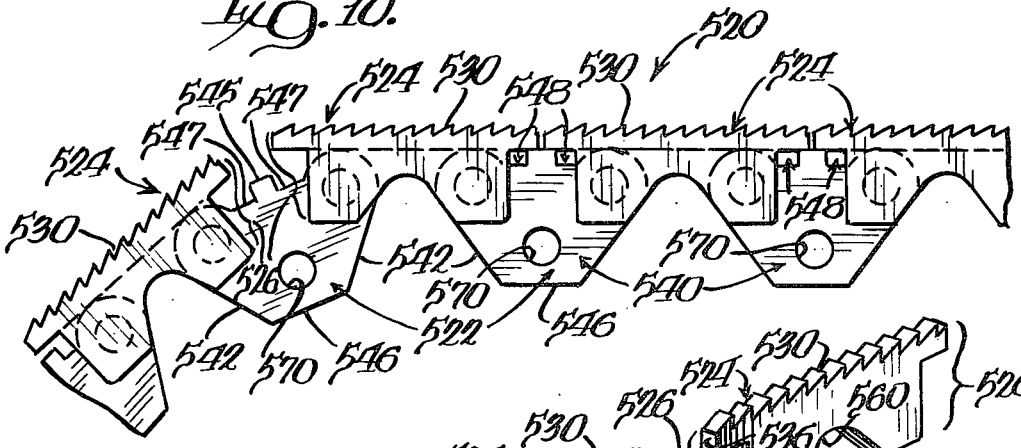
FIG. 10 is a side elevational view of an articulated saw blade illustrating yet another embodiment of this invention.
Figure 11:
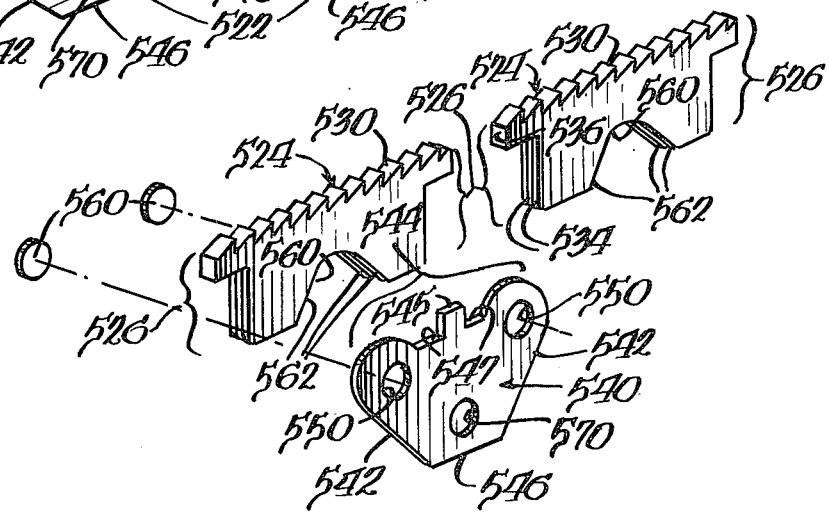
FIG. 11 is an exploded perspective view of the articulated saw blade shown in FIG. 10.

A fourth embodiment of an articulated saw blade, designated generally by reference numeral 520 in FIGS. 10 and 11, is also adapted to be disposed in saw 210 of FIGS. 6 and 7 in a manner substantially similar to saw blade 420 described above with reference to FIGS. 6–9. This particular articulated blade design is well suited for cutting relatively hard materials such as metals.

Saw blade 520 comprises an endless array of substantially planar cutting members 524 which are disposed substantially end to end to form a substantially planar, articulated band. Each substantially planar cutting member 524 in the endless array has a pair of opposed end margins 526. Each cutting member 524 also has a pair of opposed longitudinal margins, one of the longitudinal margins defining the bottom of cutting member 524 and the other of the longitudinal margins defining the top of cutting member 524 which includes a plurality of cutting teeth 530 that define a cutting face thereon. Cutting teeth 530 of each cutting member 524 can extend from one end of the cutting face to the other and together with the cutting teeth of other cutting members form a substantially continuous circumferential row of cutting teeth about the periphery of articulated blade 520.

As best illustrated in FIG. 11, each cutting member 524 includes a pair of spaced-apart sidewalls 534 which are open at the bottom of the cutting member and along the lower portions of the cutting member end margins 526. Sidewalls 534 are connected together inwardly (upwardly relative to FIG. 11) of the bottom of the cutting member at crosswall 536. At each end margin 526 of each cutting member 524, crosswall 536 extends outwardly beyond sidewalls 534 for purposes to be described in detail hereinafter.

Blade 520 includes means for connecting the cutting members in the endless array so that some number of cutting members can be oriented in a generally straight line along identical points on each cutting member as illustrated for the cutting members 524 on the righthand side of FIG. 10. Specifically, the connecting means includes planar link members 540 which are disposed in spaced end-to-end relationship. Each link member 540 has a pair of end margins 542 (which are preferably slanted as illustrated) and a pair of opposed longitudinal margins that include top longitudinal margin 544 (FIG. 11) and bottom longitudinal margin 546.

In a manner analogous to that described above for link members 440 in FIGS. 8 and 9, an end margin 542 of one link member 540 is adapted to be received between the spaced-apart sidewalls 534 at one end of one of the cutting members 524. Similarly, the other end margin 542 of link member 540 is adapted to be received between the sidewalls 534 of another cutting member 524.

Means are provided for connecting each cutting member 524 to a link member 540 in a manner similar to the manner for connecting link members 440 and cutting members 424 described above with reference to FIGS. 8 and 9. Specifically, within each end margin 542 of link member 540 is journal bearing 550. Journal bearing 550 presents a substantially right cylindrical bearing surface through each end of each link member 540. A journal 560 is disposed within each journal bearing 550. Each journal 560 is a small disc-shaped shaft and connects the spaced-apart sidewalls 534 of a cutting member 524 on either side of link member 540. Journal 560 is free to rotate within journal bearing 550, but is secured by appropriate means, such as by electron beam welding or the like, to sidewalls 536 of cutting member 525.

As can be seen for the cutting members 524 on the righthand side of FIG. 10, the cutting teeth 530 extend across the upper longitudinal margin or top of each cutting member 524 so that the top edges of teeth 530 can lie in a substantially common plane. Further, all cutting members 524 are connected within articulated band 520 so that all cutting teeth 530 are in substantially vertical alignment along any portion of the band when link members 540 in that portion are arranged with their bottom margins 546 in a common horizontal plane.

The bottom surface of bottom longitudinal margin 546 of each link member 540 is a bearing surface. This bearing surface supports each link member 540, and hence articulated band 520, in a suitable saw blade support, such as saw blade support 214 of saw 210 illustrated in FIG. 6. Saw blade 520 is supported in saw 210 in a manner substantially identical to that described above for saw blade 420 with reference to FIGS. 6–9.

Further, saw blade 520 is driven in the same manner as saw blade 420. To this end, the lower longitudinal margin of each cutting member 524, opposite cutting teeth 530, is provided with notch means or a notch defined in each sidewall 534 by arcuate wall 560 and by two generally converging walls 562 that merge with arcuate wall 560. This notch acts as a drive engagement means for being engaged by saw blade drive means 216 in the same manner as described above for saw blade 420 with reference to FIGS. 6–9.

The notches of cutting members 524 defined by the merging walls 560 and 562 function as chambers to carry chips, sawdust or other cutting material out of the kerf. Additionally, each link member 540 can be provided with one or more holes or apertures 570 adjacent the bottom margin of link member 540 to function as a trap for lubricant so that lubricant can be carried along saw blade support 214.

Upper longitudinal margin 544 of each link member 540 defines an upwardly projecting abutment surface 545 disposed between two spaced-apart notches 547 as best illustrated in FIG. 11. This link member structure, in cooperation with the connected cutting members, provides a strong blade that resists bending inwardly towards the saw support structure when saw blade 520 is cutting a workpiece.

Specifically, the inner surface of crosswall 536 at each end of a cutting member 524 functions as an engaging surface for engaging the facing abutment surface 545 of upper margin 544 of a connected link member 540. The engaging surface of cutting member crosswall 536 engages the link member abutment surface 545 when a plurality of cutting members 524 are oriented to form a generally straight line along identical points on each cutting member as illustrated in FIG. 10 for the members 524 on the righthand side of the Figure.

This type of structure permits rotation of any two adjacent cutting members 524 in opposing first directions but prevents rotation of adjacent cutting members 524 out of the straight line orientation in opposing second directions that are opposite to the first directions.

In other words, the structure prevents rotation of two adjacent connected cutting members in opposite directions (out of the cutting surface defined by teeth 530) through an angle formed between the planar cutting faces of less than about $\pi$ radians. With this structure, those cutting members being driven through the cutting region of saw blade support 214 resist inward deflection and provide a strong blade during cutting even though the cutting members may be spaced away from the edges of side retaining plates 238.

Blade 520 is especially effective for cutting metal. It has been found that the metal chips and particles produced during cutting sometimes may accumulate in a slot such as the slot defined between the sidewalls 434 of cutting member 424 in FIGS. 8 and 9. Such chips are less likely to accumulate on the relatively small abutment surface 545 of link member 540 of blade 520 in FIGS. 10 and 11. The chips fall from surface 545 and away from the saw although some of the chips may be initially received into notches 547 on either side of surface 545. When cutting members 524 and link members 540 are oriented in a generally straight line as shown on the righthand side of FIG. 10, the coaction of a cutting member 524 and a connected link member 540 cause notch 547 to be enclosed and together define an aperture 548. Thus, some of the chips that are carried in notches 547 or apertures 548 fall out as the articulated blade moves about the blade support.

This type of structure thus minimizes chip build up between the engaging surface of a cutting member crosswall 536 and the confronting link member abutment surface 545. Thus, after a cutting member and connected link member have rotated relative to one another when passing around an end of the saw, no significant amount of chips will remain on the abutment surface 545 to prevent subsequent realignment of the saw blade cutting members and link members in the substantially straight line (or slightly crowned) orientation in the cutting region of the saw between the two ends of the saw.

The cutting teeth of the saw blade embodiments described herein can be of any hardness and shape desired. The cutting teeth can be carbideclad or can be carbide or diamond particles for cutting stone, cement, or other hard material, if desired. In addition, other types of teeth, such as raker teeth or non-cutting teeth may be provided along the cutting face of each cutting member with the cutting teeth.

The saw may be powered by any suitable means such as an air motor, an internal combustion engine, an electric motor, a hydraulic motor, and the like.

The novel use of thin planar cutting members disclosed herein offers great advantages in ease and economy of manufacture. Relatively inexpensive stamping, milling or sawing, fixturing, and spot welding or electron beam welding techniques are all that is required to fabricate the saw blade of this invention. A great variety of sprocket type engagements with each blade cutting member and link member, or with only some of the blade cutting members and/or link members, can be used. The blade drive rate can also be varied with well-known means such as with a simple gear, chain, or belt reduction, if desired.

The saw disclosed herein is thus seen to have many advantages over existing power-driven saws. The present articulated saw blade can be made from relatively thin planar individual cutting members. The cutting members, being joined by novel means, add little or no extra lateral thickness to the saw blade. Thus, the cutting teeth do not have to be unnecessarily raked outwardly so as to make an enlarged kerf in order to accommodate lateral protuberances on the sides of the cutting blades. The side surfaces of the cutting members do not have laterally extending projections or protuberances and can be made very smooth. This also contributes to a smooth cut. The narrower kerf provided by this invention produces less cutting waste and, therefore, conserves material. Further, the narrower kerf requires less power and, therefore, requires less energy input to drive the saw.

The saw blade of this invention is seen to be lighter than the typical chain saw blade and thus has less momentum during operation at a given speed. Thus, with the novel saw blade of this invention, less torque is required to accelerate the articulated saw blade to the design speed in a given time interval. Further, if the articulated saw blade should break, the destructive effects of such a break would be less severe than with the heavier chain saw type blade.

Compared to reciprocating saws or hand saws, the saw of this invention is more efficient in that it continuously cuts and does not have a wasted return motion.

The saw of this invention is portable and does not have a throat limitation such as found in a conventional band saw. Thus, the saw has the advantage of unlimited vertical capacity.

Since the individual cutting members of the saw blade of this invention do not have to be made to bend or flex as does a band saw blade, the cutting members (and, where used, the link members) of this invention are not limited to only those materials that can withstand flexing and bending. This permits the use of many different types of materials, including those of any hardness or temper desired.

From the foregoing, it will be observed that numerous other variations, modifications and rearrangements of parts may be effected without departing from the true spirit and scope of this invention.

I claim:

1. A saw blade comprising:

an endless array of substantially planar cutting members which are disposed substantially end to end to form a substantially planar, articulated band;

each substantially planar cutting member in said endless array having a pair of opposed top and bottom longitudinal margins, a pair of end margins, and a plurality of cutting teeth disposed along said top margin to define a cutting face thereon;

said planar cutting members being situated in said array so as to present a circumferential row of cutting teeth about the periphery of said articulated band, said array of cutting members being adapted to define at least a cutting segment of said band wherein said cutting faces of a plurality of said cutting members define and lie along a cutting surface;

each cutting member including a pair of spaced-apart sidewalls open along the cutting member bottom longitudinal margin opposite the cutting teeth and connected together inwardly of said bottom longitudinal margin of the cutting member;

said saw blade further comprising planar link members in spaced end-to-end relationship, each said link member having a pair of end margins and a pair of opposed top and bottom longitudinal margins;

each said link member being disposed with one of its end margins received between said spaced-apart sidewalls at one end of one of said cutting members and with the other end margin received between said spaced-apart sidewalls at one end of another of said cutting members;

said saw blade further comprising means for pivotally connecting each end margin of each link member to the receiving sidewalls of an adjacent cutting member;

each said link member having its bottom longitudinal margin extending below the bottom longitudinal margins of the two cutting members pivotally connected to said link member when the two connected cutting members are oriented to lie in a generally straight line, said link member bottom longitudinal margin defining a bearing face for being disposed in a peripheral slot of a saw blade support and slidably bearing against the bottom of the slot;

each said link member having an upwardly facing abutment surface projecting upwardly at said top longitudinal margin of said link member between two spaced-apart notches defined in said link member;

each said cutting member having a downwardly facing engaging surface at each said end margin of said cutting member for engaging the abutment surface of a connected link member; and the relationship between said abutment surface of one link member and the engaging surfaces of two cutting members pivotally connected to said one link member being one of engagement when the two connected cutting members are oriented to lie in a generally straight line, said engagement thereby preventing rotation of the cutting faces of the two connected cutting members toward each other from said straight line orientation but permitting rotation of the cutting faces away from each other.

2. The saw blade in accordance with claim 1 in which each said sidewall of each said cutting member is provided with a notch means in said bottom longitudinal margin opposite said cutting face for engaging a drive means for said saw blade.

3. The saw blade in accordance with claim 2 in which said notch means in each said sidewall is defined by an arcuate surface in the sidewall and by two generally converging walls of said sidewall that merge wtih said arcuate surface.

4. The saw blade in accordance with claim 1 in which each said cutting member has between four and ten of said cutting teeth per inch along said one longitudinal margin thereof.

5. A saw blade in accordance with claim 1 in which said cutting face of each said cutting member is substantially planar.

6. A saw blade comprising:

an endless array of substantially planar cutting members which are disposed substantially end to end to form a substantially planar, articulared band;

each substantially planar cutting member in said endless array having a pair of opposed top and bottom longitudinal margins, a pair of end margins, and a plurality of cutting teeth disposed along said top margin to define a cutting face thereon;

said planar cutting members being situated in said array so as to present a circumferential row of cutting teeth about the periphery of said articulated band, said array of cutting members being adapted to define at least a cutting segment of said band wherein said cutting faces of a plurality of said cutting members define and lie along a cutting surface;

each said cutting member including a pair of spaced-apart sidewalls open along the cutting member bottom longitudinal margin opposite the cutting teeth and connected together inwardly of said bottom longitudinal margin of the cutting member;

said saw blade further comprising planar link members in spaced end-to-end relationship, each said link member having a pair of end margins and a pair of opposed top and bottom longitudinal margins;

each said link member being disposed with one of its end margins received between said spaced-apart sidewalls at one end of one of said cutting members and with the other end margin received between said spaced-apart sidewalls at one end of another of said cutting members;

said saw blade further comprising means for pivotally connecting each end margin of each link member to the receiving sidewalls of an adjacent cutting member;

each said link member having its bottom longitudinal margin extending below the bottom longitudinal margins of the two cutting members pivotally connected to said link member when the two connected cutting members are oriented to lie in a generally straight line, said link member bottom longitudinal margin defining a bearing face for being disposed in a peripheral slot of a saw blade support and slidably bearing against the bottom of the slot;

each said link member having an upwardly facing abutment surface at said top longitudinal margin of said link member;

each said cutting member having a downwardly facing engaging surface at each said end margin of said cutting member for engaging the abutment surface of a connected link member; and the relationship between said abutment surface of one link member and the engaging surfaces of two cutting members pivotally connected to said one link member being one of engagement when the two connected cutting members are oriented to lie in a generally straight line, said engagement thereby preventing rotation of the cutting faces of the two connected cutting members toward each other from said straight line orientation but permitting rotation of the cutting faces away from each other.

7. The saw blade in accordance with claim 6 in which each said sidewall of each said cutting member is provided with a notch means in said longitudinal margin opposite said cutting face for engaging a drive means for said saw blade, said notch means in each said sidewall being defined by an arcuate surface in the sidewall and by two generally converging walls of said sidewall that merge with said arcuate surface; and in which each of said two end margins of each said link member is slanted relative to said bottom longitudinal margin of said link member so as to lie in registry with one of said converging walls of a pivotally connected cutting member when said abutment surface of said link member is engaged by said engaging surface of said pivotally connected cutting member.

8. A saw blade in accordance with claim 6 in which each said link member abutment surface projects upwardly.

9. A saw blade in accordance with claim 8 in which each said link member defines to spaced-apart notches and in which said abutment surface projects upwardly between said notches.

10. A saw blade in accordance with claim 6 in said means for pivotally connecting each end margin of each link member to the receiving sidewalls of an adjacent cutting member comprises:

a journal bearing defined in each end margin of said link member by a circular aperture;

a journal received in each said aperture, each said journal having a disk configuration with oppositely facing end surfaces; and means securing each said journal at each end surface to one of said sidewalls of one of said cutting members.

* * * * *